US009057497B2

(12) United States Patent
Bakk

(10) Patent No.: US 9,057,497 B2
(45) Date of Patent: Jun. 16, 2015

(54) LED MODULE HAVING A DOUBLE DIFFUSER

(75) Inventor: Istvan Bakk, Törökbalint (HU)

(73) Assignee: Tridonic Jennersdorf, Jennersdorf (AT)

( * ) Notice: Subject to any disclaimer, the term of this patent is extended or adjusted under 35 U.S.C. 154(b) by 108 days.

(21) Appl. No.: 13/639,941

(22) PCT Filed: Apr. 5, 2011

(86) PCT No.: PCT/EP2011/055251

§ 371 (c)(1), (2), (4) Date: Oct. 31, 2012

(87) PCT Pub. No.: WO2011/124565

PCT Pub. Date: Oct. 13, 2011

(65) Prior Publication Data

US 2013/0039060 A1 Feb. 14, 2013

(30) Foreign Application Priority Data

Apr. 9, 2010 (DE) ..... 10 2010 003 800
Jun. 1, 2010 (DE) ..... 10 2010 029 593

(51) Int. Cl.

| | |
|---|---|
| ***F21V 1/00*** | (2006.01) |
| ***F21V 11/00*** | (2006.01) |
| ***F21V 5/00*** | (2015.01) |
| ***F21K 99/00*** | (2010.01) |
| *F21V 3/00* | (2015.01) |
| *F21Y 101/02* | (2006.01) |

(52) U.S. Cl.

CPC . *F21V 5/008* (2013.01); *F21K 9/00* (2013.01); *F21V 3/00* (2013.01); *F21K 9/135* (2013.01); *F21Y 2101/02* (2013.01)

(58) Field of Classification Search

None

See application file for complete search history.

(56) References Cited

U.S. PATENT DOCUMENTS

| | | | | |
|---|---|---|---|---|
| 7,901,108 | B2 * | 3/2011 | Kabuki et al. | 362/235 |
| 8,430,538 | B2 * | 4/2013 | Holder et al. | 362/311.02 |
| 2008/0198604 | A1 | 8/2008 | Kim et al. | |
| 2009/0251897 | A1 | 10/2009 | Kabuki et al. | |
| 2010/0238669 | A1 | 9/2010 | Holder et al. | |

OTHER PUBLICATIONS

International Search Report issued in connection with the corresponding International Application No. PCT/ EP2011/055251 on Jul. 6, 2011.

English translation of the International Preliminary Report on Patentability issued in connection with the corresponding International Application No. PCT/EP2011/055251 on Oct. 18, 2012.

* cited by examiner

*Primary Examiner* — Anne Hines

(74) *Attorney, Agent, or Firm* — The H.T. Than Law Group

(57) ABSTRACT

The invention relates to a LED module (7) which comprises: at least one LED chip (20, 21) mounted on a substrate, a first diffuser element (10) which scatters the light from the at least one LED chip (20, 21) diffusely, and a second diffuser element (8) which when viewed in the light beam direction is outside the first diffuser element (10) and is separated therefrom, preferably forming an air gap.

21 Claims, 2 Drawing Sheets

LED MODULE HAVING A DOUBLE DIFFUSER

BACKGROUND OF THE INVENTION

The invention deals with an LED module which can be used, for example, in retrofit LED lamps which are designed as a replacement for halogen lamps or incandescent lamps.

LED lamps are being used more and more often for illumination. Said lamps are distinguished by their high light efficiency and their longevity. Furthermore, said lamps can be used in a very flexible manner on account of their extremely small dimensions. LEDs are mostly produced in the form of LED modules. In this case, LED modules consisting of at least one blue LED which produces white light by means of wavelength conversion means arranged on the LED should be considered. RGB LED modules can be used to produce any desired colours, in which case a setting process and a dimming process can be carried out by means of PWM driving of the individual colour channels.

LED lamps can be used in the form of so-called retrofit LED lamps. In this case, the LED lamp has the form and function of a conventional light bulb, for example, but comprises one or more LEDs or one or more LED modules as luminous means. In order to match the supply current, the retrofit LED lamp also has its own driver circuit which matches the supply current to the operating conditions of the LEDs on the basis of a mains voltage supplied via the cap, for example. The LED retrofit light bulbs can therefore be screwed into conventional lamp holders like conventional light bulbs and can be operated using the mains current supplied.

However, in the case of LED modules which integrate LED chips on a common carrier, the problem arises of the emitted light from the at least two (or more) LED chips with different emission spectra having to be mixed as homogeneously as possible in order to produce white light with an adjustable colour temperature.

The known optical elements which are used to mix light are diffusers, lenses, reflectors etc. and the combinations thereof.

However, the use of a diffuser, for example, as an upper part of an LED lamp with the proposed solution results in the problem of negative shading effects being able to arise in an edge region of the upper part in the form of the diffuser. In other words, if this edge region of the upper part in the form of the diffuser is viewed with the human eye, the situation may disadvantageously occur in which locally separate spectra or colours can be seen, as a type of backlit lampshade, rather than the mixed spectrum of the at least two LED chips.

SUMMARY OF THE INVENTION

In order to remedy this problem, the invention generally proposes providing a diffuser element which is constructed with at least two shells and has a primary diffuser element and an upper part which acts as a secondary diffuser.

If the invention is described within the scope of the present description with reference to a retrofit LED lamp element which is in the shape of a candle, for example, it is still clear that the invention can also be generally applied to LED modules, in particular to those in which at least two LED chips with different emission spectra are arranged on the same plane. The solution can be integrated in LED lights, for example in ceiling lights, spotlights and table lamps.

The invention is therefore based on the object of proposing an LED module with improved colour homogeneity of the emission characteristic.

The object is achieved, according to the invention, by the features of the independent claims. The dependent claims describe advantageous developments of the invention.

One aspect of the invention provides an LED module having:

- at least one LED chip which is fitted to a carrier,
- a first ("primary") diffuser element which diffusely scatters light from the at least one LED chip, and
- a second ("secondary") diffuser element which, as seen in the light emission direction, is outside the first diffuser element and is separated from the latter, preferably with the formation of an air gap.

The LED module may have at least two LED chips with different emission spectra.

In this case, at least one LED chip may be covered with a colour conversion medium.

At least one LED chip can produce white, greenish white or green light with phosphor conversion.

At least one LED chip produces monochromatic light, for example in the red spectrum.

One diffuser element or both diffuser elements can be produced from a plastics material and/or from glass.

The first diffuser element may be in the form of a hood.

The first diffuser element may be formed such that the edge region of the hood at least laterally surrounds the LED chip(s) completely.

The wall thickness of the first diffuser element may be smaller in a region above the at least one LED chip than in that edge region of the hood-like diffuser element which diffusely scatters laterally emitted light from the at least one LED chip.

The first diffuser element may be fitted to the LED carrier or to an element which is arranged below the LED carrier and is preferably heat-dissipating.

The first diffuser element may be mechanically assembled, for example by means of latching.

The first diffuser element may be at a distance from the at least one LED chip with the formation of an air gap.

The first diffuser element may be at a distance of at least 1 mm, preferably at least 2 mm, from the LED chip.

One diffuser element or both diffuser elements may have a homogeneous or inhomogeneous wall thickness of between 0.1 mm and 5 mm, preferably between 1 mm and 3 mm.

The first diffuser element may overlap the side surfaces of the carrier for the at least one LED chip.

The first and/or second diffuser element may have colour conversion media ("remote colour conversion") which are directly above one or more of the LED chips as an alternative or in addition to a colour conversion layer.

The invention relates to an LED light having an LED module of the abovementioned type.

In this case, the invention relates, in particular, to a retrofit LED lamp having a holder for halogen or incandescent lamps as well as an LED module of the abovementioned type.

BRIEF DESCRIPTION OF THE DRAWINGS

Further advantages, properties and features of the invention are now intended to be explained with reference to the figures of the accompanying drawings, in which.

DETAILED DESCRIPTION OF THE INVENTION

Figure 1A:
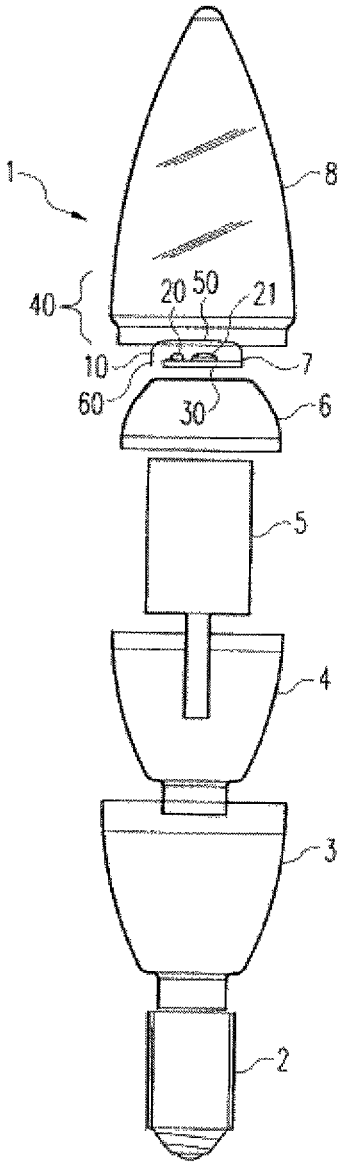
FIG. 1*a* shows an exploded view of an embodiment according to the invention of a retrofit LED lamp.
Figure 1B:
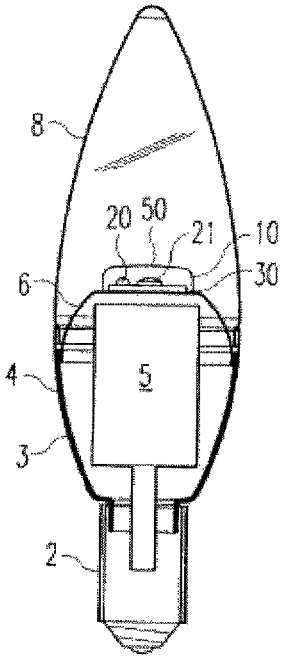
FIG. 1*b* shows the embodiment from FIG. 1*a* in assembled form.

FIGS. 1*a* and 1*b* show an embodiment according to the invention of an LED lamp having an LED module 7. This is a retrofit LED lamp 1 for use in a conventional lamp holder. For this purpose, the bulb 1 has a conventional cap 2, for example with an E14, E17 or E27 screw thread. Alternatively, a cap which is designed for a low-voltage connection, such as a G4, G5 or G6 pin cap, is also conceivable. A BA9 or BA15 bayonet cap is also conceivable.

If the retrofit LED lamp 1 is supplied with mains AC voltage or with low-volt voltage by means of an appropriate lamp holder, current matching is needed in order to correctly operate the LED module 7. The bulb has a driver circuit 5 for this purpose. The latter may have any control circuit conceivable for this use, as known from the prior art. An AC/DC converter for rectifying a mains AC voltage can be considered, for example. A DC/DC converter or another converter which reduces the voltage or the current or the power may be advantageously connected downstream of said AC/DC converter. In this case, it is possible to use a switch which is switched using pulse width modulation (PWM). A downstream current limiting circuit, for example using a transistor circuit, can also be considered.

The LED module 7 may have one or more LEDs and/or OLEDs. In this case, it is possible to use, in particular, phosphor-converted blue LEDs, RGB LED modules or the conceivable combinations thereof. The phosphor-converted LEDs are, in particular, at least one blue LED, in which some of the emitted blue light is converted into yellow or greenish yellow light by colour conversion media such as phosphor. The use of phosphor-converted green and/or greenish white LEDs is also conceivable. One or more red LEDs (or other monochromatic LEDs) which result in a higher colour rendering value and ensure warmer light are preferably also additionally used. In this case, the red LEDs may be arranged separately from the phosphor-converted blue LEDs or may be beside the latter, with the result that some of their emitted red light is likewise subjected to phosphor conversion.

The LED module may be in the form of a COB ("Chip-on-Board") module.

The LED chips 20, 21 may be covered with a potting compound which is spherical (for example in the farm of a globe top).

According to the invention, the LED module 7 now sits on an inner layer of a heat sink arrangement. The LED module and the inner layer 6 are therefore areally connected. In this case, the inner layer is as flat as possible in the region in which the LED module rests, whereby the inner layer and the LED module have a contact area which is as large as possible, that is to say they are connected over their entire surface. In this case, the inner layer may consist of an upper part 6 and a lower part 4. The inner layer can therefore at least partially enclose the driver circuit 5. The lower part 4 advantageously has an opening on the underside, through which the driver circuit can protrude or through which a conductor which makes electrical contact with the power supply can project. The upper part 6 also has a shape which is curved outwards, thus resulting in sufficient space for the driver circuit on its inside. On its outside, preferably in the centre of the curved part, it has a flat region to which the LED module 7 is fitted. The upper part 6 may thus have a shape which is approximately hemispherical and is flattened on its upper side.

The upper part 6 and lower part 4 are connected as areally as possible and therefore have heat transfer between the parts and strong mechanical fixing. A bayonet-type closure, a screw thread or a linear, conical or stepped connection can be used as a connection for this purpose. It is also conceivable for one part to be inserted into the other like a clip. As a result of the two-part design of the inner layer, it is also easier to fit the LED module 7 to the inner layer, since the upper side can be used separately from the underside for this purpose, and the driver circuit can also be inserted more easily. The upper side 6 may additionally have, in the region of the LED module, optical means such as a cavity in which the LED module is fitted. However, it is advantages in this case if the light produced can emerge at a large angle.

The inner layer consists of a current-conducting material such as metal, for example aluminium, or plastic. It therefore likewise has a high thermal conductivity.

The heat sink arrangement also has an outer layer which surrounds the inner layer, the outer layer having the largest possible surface area. This layer also consists of an upper part 8 and a lower part 3. These parts can preferably be connected using a thread, thus ensuring substantial mechanical fixing and high heat transfer as a result of a large common surface area between the parts. The outer layer preferably consists of a non-conductive material such as plastic or at least of a material which is not very conductive and has an insulating property. In addition, it has a lower thermal conductivity than the inner layer.

This results in the advantageous effect of heat being quickly transported away from the heat source, that is to say from the LED module and also from the driver circuit, using the inner layer and then being absorbed by the outer layer. For this purpose, the inner and outer layers rest against one another in an at least partially flush manner. This is the case with the two lower parts 4 and 3 in the exemplary embodiment in FIG. 1*b*. The two layers therefore have surface areas which are as large as possible and rest against one another, and the greatest possible heat transfer between the two layers is therefore ensured. For this purpose, the two lower parts 4 and 3 are also shaped in such a manner that they rest against one another as far as possible without an air gap. They may have, for example, a conical shape with low tolerances. In order to increase the surface areas of the outer and inner layers which rest against one another, it is also conceivable for the layers to have structures which correspond to one another and engage in one another, such as ribs or waves.

There is a space between the upper parts 6 and 8 of the inner and outer layers, in which space the LED module 7 is situated. This space may have optical means such as a lens. It is also possible for this space to be at least partially filled, for example with a transparent material, with the result that heat can likewise be dissipated between the two upper parts.

The lower part of the outer layer is connected to the lamp cap 2 in such a manner that both parts have a large common surface area. High heat transfer between the outer layer and the lamp cap is therefore ensured.

The outer layer is also at least partially translucent or transparent, in particular in the region of the upper part 8, with the result that the light produced by the LED module 7 shines through. The upper part 8 may also have optical properties such as a lens, diffuser particles or others.

The lower part 3 has a thickness of at least 100 μm, preferably of at least 200 μm, and yet more preferably of at least 500 μm, but most preferably of at least 1000 μm.

There may be a gap between the inner layer and the driver circuit. Said gap may be filled with air. It is also conceivable for said gap to be filled with a potting compound. In this case, the potting compound may also constitute a connection between all parts of the cooling arrangement, the lamp cap 2 and the driver circuit. Mechanical fixing and heat transfer between the parts are therefore promoted.

Contact between the inner and outer layers can also be made by the inner layer constituting a metal insert in an outer layer produced using moulding methods. In this case, mechanical fixing can be produced using standard methods such as ribs or cavities in the metal insert. The outer layer and the metal insert, that is to say the inner layer, can also be connected using a connecting means such as adhesive, lubricating grease, cement or an elastomer. The use of plastic inserts is also conceivable.

The inner layer may at least partially have an additional, third layer on its inner surface. This third layer has insulating properties. The driver circuit can therefore be protected further from short circuits. In this case, it is conceivable for this insulating layer to have a recess in the region below the LED module, with the result that an electrical connection can be established between the driver circuit and the LED module via the inner conductive layer. However, it is also conceivable for the third layer to be continuous and for the inner layer and third layer to be drilled through in the region of the LED module so that conductors can make contact with the latter.

As diagrammatically shown in FIGS. 1*a* and 1*b*, the LED module 7 may have a common printed circuit board 30 to which at least two LED chips 20, 21 are applied. In this case, the LED chips 20, 21 preferably emit light with different spectra. For example, the LED chip 20 can emit white light with phosphor conversion, while the LED chip(s) 21 can emit monochromatic light, for example in the reddish region. One particular embodiment relates in this case to the fact that the mixed spectrum of the LED lamp, for example the colour temperature of white light, can be set by appropriately individually driving the LED chips 20, 21 with different spectra.

However, on account of the arrangement of the LED chips 20, 21 on the common printed circuit board 30 or generally at the same level, the problem arises of negative shading effects being able to arise in an edge region of the upper part 8 in the form of the diffuser. In other words, if this edge region 40 of the upper part 8 in the form of the diffuser is viewed with the human eye, the situation may disadvantageously occur in which locally separate spectra or colours can be seen, as a type of backlit lampshade, rather than the mixed spectrum of the two LED chips 20, 21.

In order to remedy this problem, the invention generally proposes providing a diffuser element which is constructed with at least two shells and has a primary diffuser element 10 and the upper part 8 which acts as a secondary diffuser. If the invention is described within the scope of the present description with reference to a retrofit LED lamp element which is in the shape of a candle, for example, it is still clear that the invention can also be generally applied to LED modules, in particular to those in which at least two LED chips with different emission spectra are arranged on the same plane.

As is clear in FIG. 1*a*, the primary diffuser element 10 may enclose the LED chips 20, 21 like a hood. This may be a rounded hood (for example with a U-shaped or box-shaped cross section).

As is clear in FIGS. 1*a* and 1*b*, the hood-shaped primary diffuser element 10 is formed in this case in such a manner that the edge region of the hood at least laterally surrounds the LED chips 20, 21 completely. In the example illustrated in FIGS. 1*a*, 1*b*, the hood-shaped primary diffuser element 10 is even pulled further down, namely onto the heat sink body 6 to which the printed circuit board 30 of the LED module 7 is fitted, again in thermal contact.

Both the upper part 8 and the primary diffuser element 10 may be produced from a plastics material, for example polycarbonate, containing polystyrene, polyester, polymethyl methacrylate (PMMA) or their copolymers. The diffuser elements may contain plastics particles, in which case the indices of refraction of the particle core and the particle shell preferably do not match. The plastics particles may be distributed in a polymer matrix.

The two diffuser elements may also be produced from glass or glass/plastic mixtures.

The secondary diffuser element (upper part) 8 is preferably at an average minimum distance of, for example, at least 1 mm, preferably at least 3 mm, from the primary diffuser element 10 with the formation of an air gap.

The primary diffuser element and the secondary diffuser element may be produced as an integral piece which has the appearance of a double shell.

The primary diffuser element 10 is in turn preferably at a homogeneous or inhomogeneous distance of at least 1 mm, more preferably of at least 2 mm, from the respective nearest LED chips 20, 21, again preferably with the formation of an air gap (an intermediate space filled with gaseous medium).

The wall thickness of the primary diffuser element 10 and/or of the upper part 8 which acts as a secondary diffuser can respectively be homogeneous or inhomogeneous. The homogeneous or inhomogeneous wall thickness can be between 0.1 mm and 5 mm, preferably between 1 mm and 3 mm.

With respect to the primary diffuser element 10, that region 50 of the primary diffuser element 10 which is above the LED chips 20, 21, for example, may have a reduced wall thickness in comparison with the region 60 of the hood-like primary diffuser element 10.

The primary diffuser element 10 may be fitted to a carrier, for example also to the printed circuit board 30 of the LED module 7, mechanically (by means of clips, latching, adhesive bonding, etc.).

Figure 2:
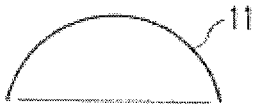
FIGS. 2 and 3 show further exemplary embodiments of a primary diffuser according to the present invention.

In a departure from the box shape of the primary diffuser element in FIGS. 1*a*, 1*b*, the primary diffuser element 11 may also be spherical, as is clearly shown in FIG. 2.

Figure 3:
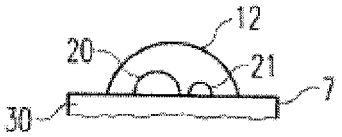

FIG. 3 shows an exemplary embodiment in which the primary diffuser element 12 is directly arranged on the printed circuit board 30 of the LED module 7, which also bears the LED chips 20, 21.

Light from the LED chips 20, 21 is therefore diffusely scattered by the primary diffuser element 10, 11, 12. Since the human eye cannot directly look at the primary diffuser element 10, 11, 12, but only at the secondary diffuser element which is outside and is in the form of the upper part 8, when LED lamps are assembled, colour separation can advantageously no longer be perceived. Even when the edge region 40 of the secondary diffuser element 8 is viewed directly, the human eye will therefore see a mixed spectrum of the LED chips 20, 21 but no spatially separate colour effects.

The first and/or second diffuser element may have colour conversion means ("remote colour conversion") which are directly, that is to say without an air gap, above one or more of the LED chips as an alternative or in addition to a colour conversion layer.

The invention claimed is:

1. LED module having:

at least one LED chip which is fitted to a carrier, a first diffuser element which diffusely scatters light from the at least one LED chip, and a second diffuser element which, as seen in the light emission direction, is outside the first diffuser element and is separated from the latter, wherein the second diffuser element is separated from the first diffuser element by an air gap.

2. LED module according to claim 1, having at least two LED chips with different emission spectra.

3. LED module according to claim 1, wherein at least one LED chip is covered with a colour conversion medium.

4. LED module according to claim 1, wherein one diffuser element or both diffuser elements is/are produced from a plastics material and/or from glass.

5. LED module according to claim 1, wherein the first diffuser element is in the form of a hood.

6. LED module according to claim 5, wherein the first diffuser element is formed such that the edge region of the hood formed at least laterally surrounds the LED chip(s) completely.

7. LED module according to claim 5, wherein the wall thickness of the first diffuser element is smaller in a region above the at least one LED chip than in that edge region of the hood-like diffuser element which diffusely scatters laterally emitted light from the at least one LED chip.

8. LED module according to claim 1, wherein the first diffuser element is fitted to the LED carrier or to an element which is arranged below the LED carrier.

9. LED module according to claim 8, wherein the first diffuser element is heat-dissipating.

10. LED module according to claim 1, wherein the first diffuser element is mechanically assembled, for example by means of latching.

11. LED module according to claim 1, wherein the first diffuser element is at a distance from the at least one LED chip with the formation of an air gap.

12. LED module according to claim 11, wherein the first diffuser element is at a distance of at least 1 mm from the LED chip.

13. LED module according to claim 12, wherein the first diffuser element is at a distance of at least 2 mm from the LED chip.

14. LED module according to claim 1, wherein one diffuser element or both diffuser elements has/have a homogeneous or inhomogeneous wall thickness of between 0.1 mm and 5 mm.

15. LED module according to claim 14, wherein said wall thickness is between 1 mm and 3 mm.

16. LED module according to claim 1, wherein the first diffuser element overlaps the side surfaces of the carrier for the at least one LED chip.

17. LED module according to claim 1, wherein the first and/or second diffuser element has/have colour conversion media ("remote colour conversion") which are directly above one or more of the LED chips as an alternative or in addition to a colour conversion layer.

18. A LED light, having an LED module according to claim 1.

19. A retrofit LED lamp having a holder for halogen or incandescent lamps as well as an LED module according to claim 1.

20. LED module having:

at least one LED chip which is fitted to a carrier, a first diffuser element which diffusely scatters light from the at least one LED chip, and a second diffuser element which, as seen in the light emission direction, is outside the first diffuser element and is separated from the latter, wherein at least one LED chip is covered with a colour conversion medium and produces white, greenish white or green light with phosphor conversion.

21. LED module having:

at least one LED chip which is fitted to a carrier, a first diffuser element which diffusely scatters light from the at least one LED chip, and a second diffuser element which, as seen in the light emission direction, is outside the first diffuser element and is separated from the latter, wherein at least one LED chip produces monochromatic light in the red spectrum.

* * * * *